US008585435B2

(12) United States Patent
Hur et al.

(10) Patent No.: US 8,585,435 B2
(45) Date of Patent: Nov. 19, 2013

(54) CONTACT COVER AND SHUNT FOR NOTIFICATION APPLIANCE MOUNTING PLATES AND METHOD FOR INSTALLATION

(75) Inventors: Inhong Hur, Oakhurst, NJ (US); Timothy Nicholas Sorenson, Bradenton, FL (US)

(73) Assignee: Wheelock, Inc., Long Branch, NJ (US)

( * ) Notice: Subject to any disclaimer, the term of this patent is extended or adjusted under 35 U.S.C. 154(b) by 312 days.

(21) Appl. No.: 12/857,326

(22) Filed: Aug. 16, 2010

(65) Prior Publication Data

US 2012/0040543 A1 Feb. 16, 2012

(51) Int. Cl.
*H01R 31/08* (2006.01)

(52) U.S. Cl.
USPC ..... 439/507; 439/677

(58) Field of Classification Search
USPC ..... 439/507–511, 514, 677, 680, 135
See application file for complete search history.

(56) References Cited

U.S. PATENT DOCUMENTS

| | | | | |
|---|---|---|---|---|
| 5,462,440 | A * | 10/1995 | Rothenberger | 439/66 |
| 5,906,508 | A * | 5/1999 | Jeffcoat | 439/509 |
| 6,428,363 | B2 * | 8/2002 | Tamai et al. | 439/677 |
| 7,611,384 | B2 * | 11/2009 | Maguire | 439/627 |

* cited by examiner

*Primary Examiner* — Felix O Figueroa

(57) ABSTRACT

A contact cover for a notification appliance mounting plate is disclosed. In one embodiment, the contact cover includes a plastic body, wherein the plastic body is sized to cover less than an entire surface area of the notification appliance mounting plate, at least one piece of metal, a means for coupling said at least one piece of metal to said plastic body and one or more polarized tabs.

10 Claims, 5 Drawing Sheets

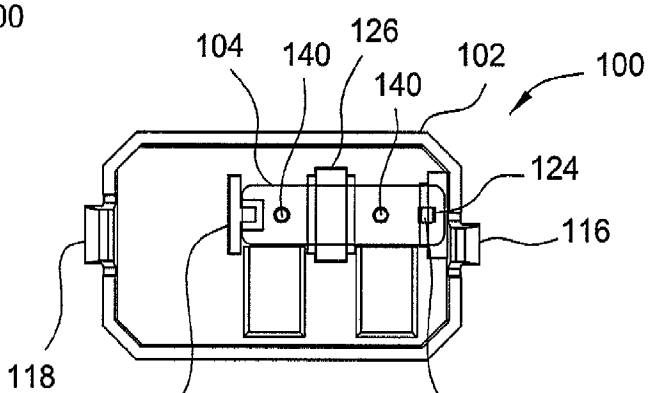
FIG. 1
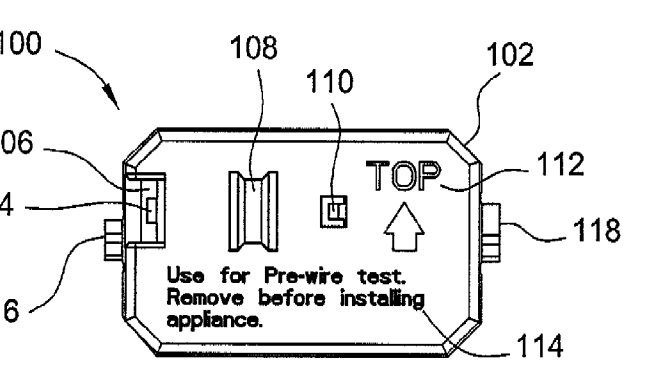
FIG. 2
FIG. 3
FIG. 4

CONTACT COVER AND SHUNT FOR NOTIFICATION APPLIANCE MOUNTING PLATES AND METHOD FOR INSTALLATION

BACKGROUND

Construction of new buildings requires various ordinances to be met with respect to fire safety. As a result, notification appliances are installed in the buildings.

Currently, notifications appliances are installed using a mounting plate. However, before the notification appliance is installed onto the mounting plate, other steps need to be performed or time may pass between installation of the mounting plate and the notification appliance. If the terminals on the mounting plate are exposed during this time, they may be affected by contamination such as debris, dust, oxidation due to air or moisture exposure, paint and the like. In addition, some of the terminals on the mounting plate may need to be connected to allow for proper testing before the notification appliances are installed onto the mounting plate.

SUMMARY

The present disclosure is directed towards a contact cover for a notification appliance mounting plate and a method for installation. In one embodiment, the contact cover comprises a plastic body, wherein the plastic body is sized to cover less than an entire surface area of the notification appliance mounting plate, a metal shunt, a locking tab for locking the metal shunt to the plastic body and one or more polarized tabs.

In another embodiment, the contact cover comprises a plastic body, wherein the plastic body is sized to cover less than an entire surface area of the notification appliance mounting plate, at least one piece of metal, a means for coupling said at least one piece of metal to said plastic body and one or more polarized tabs.

In one embodiment, the present disclosure discloses a method for installing a notification appliance mounting plate. The method comprises providing a notification appliance mounting plate having a contact cover pre-connected to the notification appliance mounting plate, mounting said notification appliance mounting plate to a wall, connecting one or more wires to one or more respective terminals on the notification appliance mounting plate, performing a connectivity test, removing said contact cover after performing the connectivity test and coupling a notification appliance to the notification appliance mounting plate.

BRIEF DESCRIPTION OF THE DRAWINGS

The teachings of the present invention can be readily understood by considering the following detailed description in conjunction with the accompanying drawings, in which:

FIG. 1 is a top view of one embodiment of a contact cover;

FIG. 2 is a side view of one embodiment of the contact cover;

FIG. 3 is a bottom view of one embodiment of the contact cover;

FIG. 4 is a cross sectional view of one embodiment of the contact cover;

To facilitate understanding, identical reference numerals have been used, where possible, to designate identical elements that are common to the figures.

DETAILED DESCRIPTION

Figure 9:
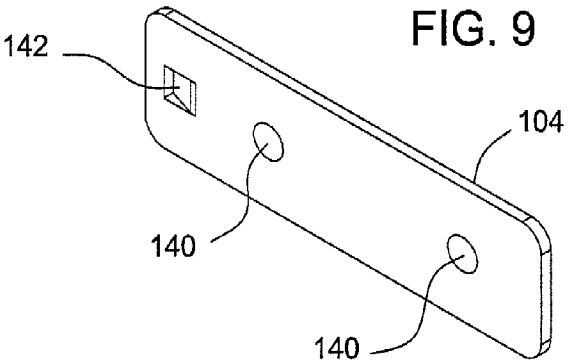
FIG. 9 is an isometric top view of one embodiment of the metal shunt.

In one embodiment, the present disclosure teaches a contact cover and shunt for notification appliance pre-wire mounting plates and a method of installation. The contact cover described in the present disclosure provides a better design at lower costs than other contact covers currently available.

The contact cover described in the present disclosure provides numerous advantages over other contact covers currently available. For example, the contact cover described in the present disclosure allows pre-wiring to be connected to terminals on a notification appliance mounting plate without removing the contact cover. The notification appliance mounting plate may be shipped with the contacts of the terminal covered and protected by the contact cover. This prevents the contacts from being exposed to construction debris, paint, excess moisture and air that can cause rusting of the contacts or accidental damage during installation of the notification appliance mounting plate. In one embodiment, a connectivity test can be performed with the contact cover in place. The contact cover only needs to be removed immediately before a notification appliance is installed onto the notification appliance mounting plate. As a result, the contacts of the notification appliance mounting plate are protected from shipment to the customer, through installation of the notification appliance mounting plate itself, testing and right up to the point of installing the notification appliance to the notification appliance mounting plate.

FIGS. 1-4 illustrate various views of one embodiment of a contact cover 100 of the present disclosure. FIG. 1 illustrates a top view of the contact cover 100. The contact cover 100 comprises a plastic body 102. The plastic body 102 may comprise any type of plastic.

The size of the plastic body 102 is one important feature of the contact cover 100. The size of the plastic body 102 should be smaller than the size of a notification appliance mounting plate that it will be connected to. This is better illustrated below with reference to FIGS. 13 and 14 and discussed below. Said another way, the size of the plastic body 102 should be large enough to cover all the contacts of the notification appliance mounting plate, but small enough not to cover the terminals or any mounting holes of the notification appliance mounting plate. Properly sizing the plastic body 102 will allow the contact cover 100 to remain on the notification appliance mounting plate up until the point immediately before a notification appliance is installed onto the notification appliance mounting plate.

The plastic body 102 may include various features. In one embodiment, the plastic body 102 may include machined openings 106, 108 and 110 to allow for insertion of at least one piece of metal 104. It should be noted that in an alternate embodiment no openings may be needed in the plastic body 102 depending on how the at least one piece of metal 104 is coupled to the plastic body 102. In one embodiment, the multiple openings 106, 108 and 110 allow for ease of insertion of the at least one piece of metal 104 into the plastic body 102.

The plastic body 102 may also include one or more markings 112 and 114. The markings 112 may provide details on a proper orientation of the contact cover 100. The markings 114 may provide instructions, such as for example, how to use the contact cover 100, when the contact cover 100 should be removed, and the like.

In one embodiment, the plastic body 102 is a different color than a color of the notification appliance mounting plate. For example, the plastic body 102 can be white, while the notification appliance mounting plate is red. This helps a technician to see that the contact cover 100 is still coupled to the notification appliance mounting plate so that the technician will remove the contact cover 100 before installing a notification appliance onto the notification appliance mounting plate.

The contact cover 100 also comprises one or more tabs 116 and 118. The tabs 116 and 118 can be molded as part of the plastic body 102 or can be fabricated separately and coupled to the plastic body 102.

In one embodiment, the contact cover 100 is polarized via polarized tabs 116 and 118. For example, the contact cover 100 includes a first tab 116 having a first size and a second tab 118 having a second size. The first tab 116 having the first size mates with a first sized opening on the notification appliance mounting plate. The second tab 118 having the second size mates with a second sized opening on the notification appliance mounting plate.

The different sized tabs 116 and 118 provide polarization of the contact cover 100. In other words, by polarizing the contact cover 100, the contact cover 100 can only be coupled to a notification appliance mounting plate in one direction. This is to ensure that the at least one piece of metal 104 properly connects two or more contacts of the notification appliance mounting plate. This is discussed in further detail below.

Although the present disclosure teaches polarizing the contact cover using different sized tabs, it should be noted that other methods may be used to polarize the contact cover. For example, the tabs may have different shapes.

FIG. 2 illustrates a side view of one embodiment of the contact cover 100. FIG. 2 also depicts tab 118. The tab 118 may also include a notch 120. The notch 120 helps to lock the contact cover 100 in place when coupled to the notification appliance mounting plate. The tab 116 may also include a similar notch 120 (not shown). Although the tabs 116 and 118 are illustrated as being along a width of the contact cover 100, it should be noted that the tabs 116 and 118 can also be along a length of the contact cover 100.

FIG. 3 illustrates a bottom view of one embodiment of the contact cover 100. FIG. 3 better illustrates the at least one piece of metal 104 coupled to the contact cover 100. The at least one piece of metal 104 may be also referred to as a metal shunt 104. The at least one piece of metal 104 may comprise phosphor bronze due to low resistance, spring properties and a nickel finish to prevent oxidation. It should be noted that other types of metals may be used such as spring brass.

The at least one piece of metal 104 may take various forms. In one embodiment, as illustrated in FIG. 3, the at least one piece of metal 104 may be in the form of a relatively thin rectangular piece of metal described in more detail with reference to FIGS. 5-10 below. In one embodiment, the thickness of the at least one piece of metal 104 is less than a thickness of a slotted opening formed by opening 106.

Figure 11:
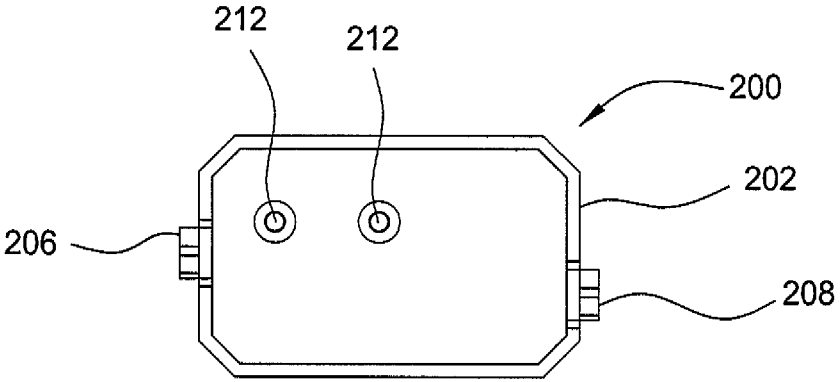
FIG. 11 is a bottom view of a second embodiment of a contact cover.
Figure 12:
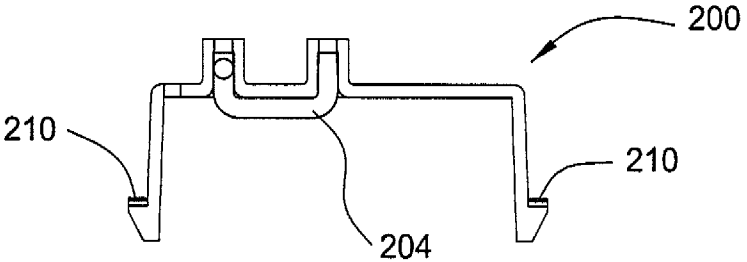
FIG. 12 is a side view of the second embodiment of the contact cover.

In other embodiments, the at least one piece of metal 104 may be in the form of a scrapped printed circuit boards (PCB) to save costs. In yet another embodiment, the at least one piece of metal may be in the form of a copper wire, as illustrated in FIGS. 11 and 12 and discussed below.

Referring also to FIG. 4, the sides or walls 130 of the contact cover 100 create an interior volume 132 of the contact cover 100. The at least one piece of metal 104 is coupled to the contact cover 100 inside the interior volume 132 of the contact cover. The at least one piece of metal 104 is positioned within the interior volume 132 such that when the contact cover 100 is coupled to a notification appliance mounting plate that the at least one piece of metal 104 connects two or more contacts of the notification appliance mounting plate. In other words, the at least one piece of metal 104 completes the circuit with two terminals of the notification appliance mounting plate. This is beneficial for performing connectivity testing before a notification appliance is installed onto the notification appliance mounting plate.

In one embodiment, the at least one piece of metal 104 is kept in place by one or more features. For example, a locking tab 122 may be used to keep the at least one piece of metal 104 in place. The locking tab 122 is also used to maintain the at least one piece of metal 104 at a proper elevation to allow the at least one piece of metal 104 to make a proper connection with contacts on the notification appliance mounting plate.

A slot 126 may be used to slide the at least one piece of metal 104 through and also help keep the at least one piece of metal 104 in place. The slot 126 also serves as a divider to create two separate contact areas for contacts on the notification appliance mounting plate.

A depression 124 near the opening 106 may be used to mate with a barb 142 on the at least one piece of metal 104. The mating of the barb 142 with the depression 124 prevents the at least one piece of metal 104 from sliding out of the plastic body 102. In one embodiment, the depression 124 may work with the locking tab to ensure that the at least one piece of metal 104 is at a proper elevation.

For example, a depth of the depression 124 may lie in the same plane as a flat surface of the locking tab 122. Said another way, a distance from an inner surface of the plastic body 102 to the depression 124 may be the same distance as a height of the locking tab 122. It should be noted that all of the features 122, 124 and 126 may be machined from a single piece of plastic into the plastic body 102 or may be separately fabricated and coupled to the plastic body 102.

The at least one piece of metal 104 also includes one or more dimples 140. The one or more dimples 140 fills an air gap such that the at least one piece of metal 104 does not slide out of the plastic body 102 even though a very thin piece of metal is being used.

The dimples 140 allow the tolerance of the openings 106, 108 and 110 to be greater. The dimples 140 also allow thinner pieces of metal to be used. The combination of these factors significantly lowers the cost of manufacturing the contact cover 100.

Figure 10:
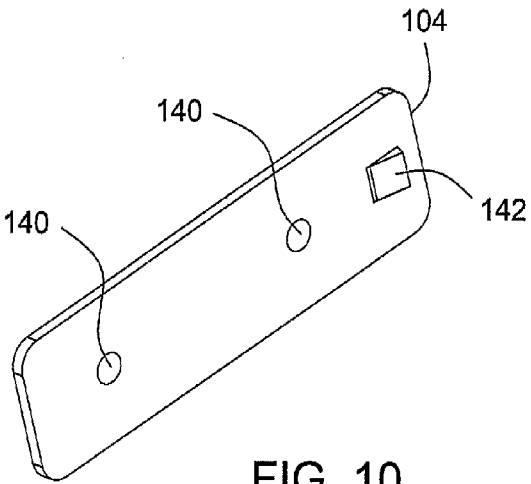
FIG. 10 is an isometric bottom view of one embodiment of the metal shunt.
Figure 5:
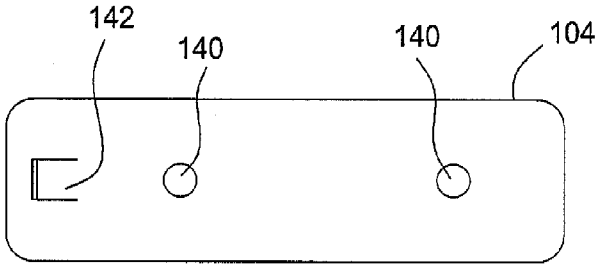
FIG. 5 is a top view of one embodiment of a metal shunt.
Figure 6:
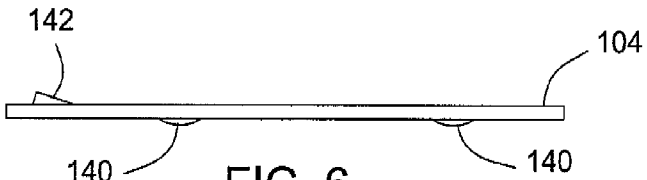
FIG. 6 is a side view of one embodiment of the metal shunt.
Figure 7:
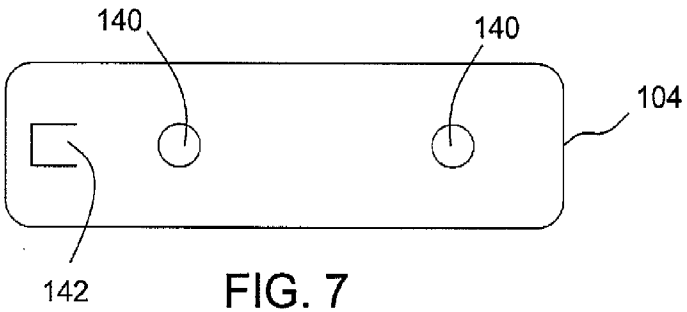
FIG. 7 is a bottom view of one embodiment of the metal shunt.
Figure 8:
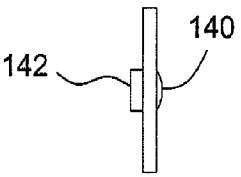
FIG. 8 is another side view of one embodiment of the metal shunt.

FIGS. 5-10 illustrate various different views of one embodiment of the at least one piece of metal 104. FIG. 5 illustrates a top view of one embodiment of the at least one piece of metal 104. FIG. 6 illustrates a side view along a length of one embodiment of the at least one piece of metal 104. FIG. 7 illustrates a bottom view of one embodiment of the at least one piece of metal 104. FIG. 8 illustrates a side view along a width of one embodiment of the at least one piece of metal 104. FIG. 9 illustrates an isometric top view of one embodiment of the at least one piece of metal 104. FIG. 10 illustrates an isometric bottom view of one embodiment of the at least one piece of metal 104.

It should be noted that although the at least one piece of metal 104 is illustrated in the shape of a rectangle in FIGS. 1-10, the at least one piece of metal 104 may be in any geometric shape. For example, the at least one piece of metal 104 can also be in the shape of a thin disc, a thin square and the like. The size of the at least one piece of metal 104 is a function of the dimensions of the notification appliance mounting plate. The size of the at least one piece of metal 104 must be large enough to contact two or more contacts of the notification appliance mounting plate, but small enough to fit into the interior volume 132 of the contact cover 100.

In one embodiment, a notification appliance mounting plate may comprise multiple sets of terminals, with each terminal having one or more contacts. As a result, more than one piece of metal 104 may be inserted into the contact cover 100. For example, the notification appliance mounting plate may include multiple sets of terminals (e.g., two sets of terminals). As a result, the contact cover 100 is sized to cover only an area of the notification appliance mounting plate that contains the plurality of contacts for each set of the multiple sets of terminals. Accordingly, multiple pieces of metal 104 can be used for each one of the multiple sets of terminals.

The features of the contact cover 100 that hold the at least one piece of metal 104 in place illustrated in FIG. 3 may be replicated for each one of the pieces of metal 104. For example, the contact cover 100 may include two locking tabs 122, two slots 126, two depressions 124, and so forth. In one embodiment, this may be accomplished by creating a slot on opposite ends of the contact cover 100. As a result, each opposing end would have a locking tab 122, a slot 126 and a depression 124 with a piece of metal 104 inserted into each opposing end. However, it should be noted that other configurations are possible for inserting multiple pieces of metal 104 into the contact cover 100 and that the above example is provided as only one possible configuration.

Consequently, a first piece of metal 104 connects two or more contacts of a first terminal and a second piece of metal 104 connects two or more contacts of a second terminal, and so forth depending on the number of contacts and terminals on the notification appliance mounting plate. As a result, connectivity testing can be performed on multiple terminals on a single notification appliance mounting plate.

FIGS. 11 and 12 illustrate another possible embodiment for a contact cover 200. The contact cover 200 comprises a plastic body 202, at least one piece of metal 204 and one or more tabs 206 and 208.

The plastic body 202 may comprise any type of plastic. Similar to the plastic body 102, the plastic body 202 is sized to be smaller than the size of a notification appliance mounting plate. In addition, the plastic body 202 is large enough to cover all of the contacts of the notification appliance mounting plate, but small enough to not cover the terminals or any mounting holes of the notification mounting plate.

The plastic body 202 may include one or more openings 212. FIG. 11 illustrates a bottom view of the one or more openings 212. In one embodiment, the one or more openings 212 are machined into the plastic body 202 and form an enclosed cylindrical opening. The one or more openings 212 have a depth that is sized to maintain the at least one piece of metal 204 at a proper elevation to allow the at least one piece of metal 204 to make a proper connection with the contacts on the notification appliance mounting plate.

FIG. 12 illustrates a cross-sectional view of the contact cover 200 and how the openings 212 protrude out of a top of the plastic body 202. In one embodiment, the plastic body 202 includes two openings 212.

The at least one piece of metal 204 may be a metal wire, e.g., a copper wire. Each end of the metal wire may be inserted into an opening 212 of the plastic body 202. The openings 212 are enclosed to ensure that the contact cover 200 keeps the contacts of the notification appliance mounting plate protected from debris, paint, moisture and accidental damage during installation. The openings 212 may have a diameter that is slightly larger than a diameter of the metal wire. This ensures that the metal wire is securely fastened to the plastic body 202 via the openings 212.

The openings 212 are positioned into the plastic body 202 to ensure that the at least one piece of metal is properly aligned with two or more contacts of the notification appliance mounting plate. This allows connectivity testing of the notification appliance mounting plate to be performed while the contact cover 200 is coupled to the notification appliance mounting plate.

The contact cover 200 is polarized using the one or more tabs 206 and 208. For example, the first tab 206 and the second tab 208 may be a different size. The first tab 206 and the second tab 208 mate with a respectively sized opening on the notification appliance mounting plate. This ensures that the contact cover 200 can be coupled to the notification appliance mounting plate in only one direction and that the at least one piece of metal 204 properly establishes a connection with the two or more contacts of the notification appliance mounting plate.

The one or more tabs 206 and 208 may also comprise a notch 210. The notch 210 helps to lock the contact cover 200 in place when coupled to the notification appliance mounting plate.

Figure 13:
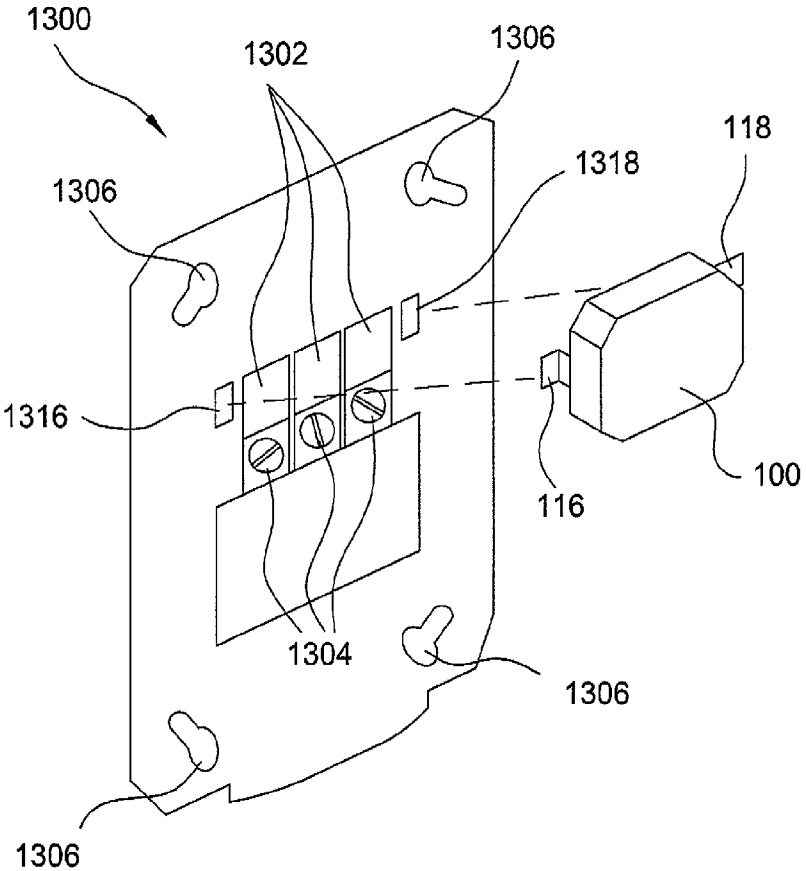
FIG. 13 is an isometric view illustrating one embodiment how the contact cover is coupled to a notification appliance mounting plate.

FIG. 13 illustrates an isometric view of one embodiment of how the contact cover 100 is coupled to a notification appliance mounting plate 1300. In one embodiment, the notification appliance mounting plate 1300 includes one or more contacts 1302, one or more terminals 1304, one or more mounting holes 1306, a first opening 1316 and a second opening 1318.

As discussed above, the notification appliance mounting plate 1300 may include multiple sets of terminals 1304. For example, the first set of terminals 1304 may comprise one or more contacts 1302 and the second set of terminals 1304 may comprise one or more contacts and so forth. The notification appliance mounting plate 1300 is not limited to any particular number of terminals or number of sets of terminals.

In one embodiment, the contact cover 100 is coupled to the notification appliance mounting plate 1300 by inserting the first sized tab 116 into the first opening 1316 and the second sized tab 118 into the second opening 1318. In one embodiment, the first opening 1316 and the second opening 1318 may be slotted such that the contact cover 100 can slide down and "lock" into place after the first sized tab 116 and the second sized tab 118 are inserted into the first opening 1316 and the second opening 1318, respectively.

In one embodiment, the first opening 1316 is sized to only receive the first sized tab 116 and the second opening 1318 is sized to only receive the second sized tab 118. In other words, the contact cover 100 would not couple to the notification appliance mounting plate 1300 if a technician were to rotate the contact cover 100 in any direction or in any amount. The contact cover 100 couples to the notification appliance mounting plate 1300 in only one direction.

Figure 14:
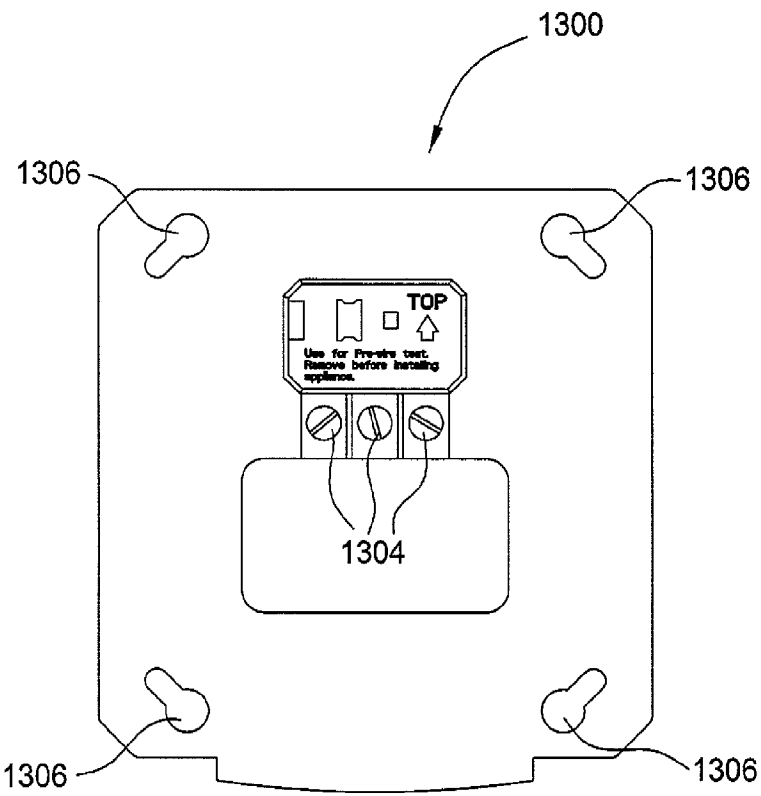
FIG. 14 is a front view of one embodiment of the contact cover coupled to the notification appliance mounting plate.

FIG. 14 illustrates a front view of the contact cover 100 coupled to the notification appliance mounting plate 1300. As discussed above, the size of the contact cover 100 is an important feature. As illustrated in FIG. 14, the contact cover 100 is smaller than the notification appliance mounting plate 1300. As a result, none of the mounting holes 1306 are covered by the contact cover 100.

In addition, the contact cover 100 is large enough to cover all of the contacts 1302. However, the contact cover 100 is small enough not to cover the terminals 1304. As a result, the contact cover 100 of the present disclosure allows the notification appliance mounting plate 1300 to be shipped to the customer with the contact cover 100 already coupled to it. Moreover, the notification appliance mounting plate 1300 can be installed and the connectivity testing can be performed after installation, all without ever removing the contact cover 100. For example, the contact cover 100 does not need to be removed to gain access to the mounting holes 1306 nor to connect wires to the terminals 1304. Thus, the contacts 1302 are protected from debris, paint, oxidation and accidental damage from shipment of the product, through installation and testing and right up to the point immediately before a notification appliance is installed onto the notification appliance mounting plate 1300.

Figure 15:
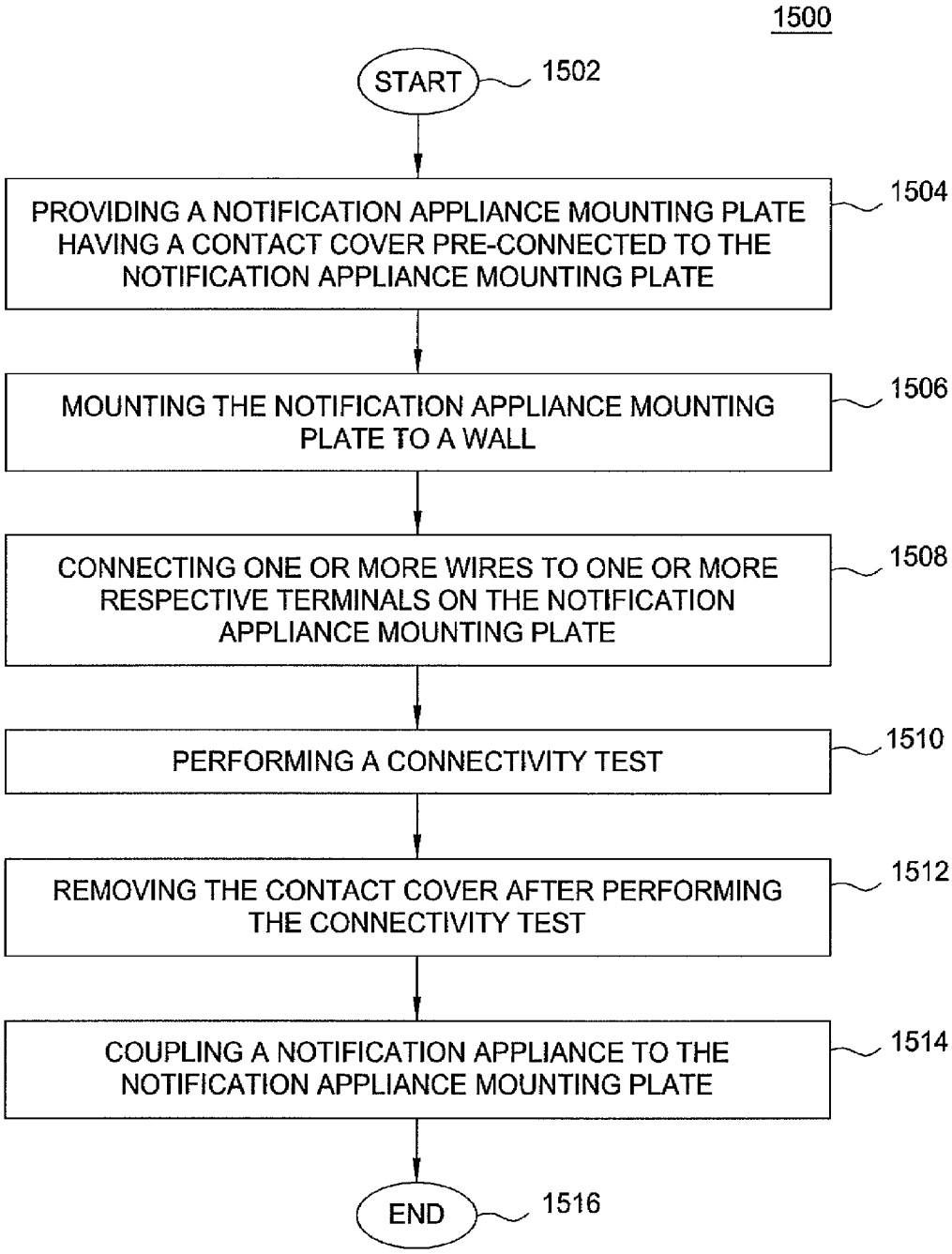
FIG. 15 is a flow diagram illustrating one embodiment of a method for installing a notification appliance mounting plate, according to the present invention.

FIG. 15 is a flow diagram illustrating one embodiment of a method 1500 for installing a notification appliance mounting plate, according to the present disclosure. The method 1500 provides a method that prevents the contacts of a notification appliance mounting plate from being exposed to construction debris, paint, oxidation or accidental damage during installation. That is, the contacts are protected up to the point immediately before a notification appliance is installed onto the notification appliance mounting plate.

The method 1500 is initialized at step 1502. At step 1504, the method 1500 provides a notification appliance mounting plate having a contact cover pre-connected to the notification appliance mounting plate. For example, the manufacturer may have coupled the contact cover to the notification appliance mounting plate before shipping the notification appliance mounting plate to a customer.

At step 1506, the method 1500 mounts the notification appliance mounting plate to a wall. For example, the notification appliance mounting plates are typically mounted to a wall or ceiling during construction of a building.

At step 1508, the method connects one or more wires to one or more respective terminals on the notification appliance mounting plate. For example, the building may be wired to connect all of the notification appliances together. However, the notification appliances are typically connected to a notification appliance mounting plate. Thus, the electrical wiring of the building is connected to the notification appliance mounting plate, which then connects to the notification appliance itself.

At step 1510, the method 1500 performs a connectivity test. In one embodiment, after all of the notification appliance mounting plates are wired and before the notification appliances are installed, connectivity testing is performed. This is to ensure that all of the notification appliance mounting plates are properly connected and wired together. In one embodiment, the two "+" terminals on the notification appliance mounting plate are connected to perform the connectivity test. The contact cover is designed to properly protect the contacts and properly connect the two "+" terminals for the connectivity testing.

It should be noted that in the method 1500 the contact cover never needs to be removed from installation to testing. Thus, even if the installation occurs over days and there are many days between installation and testing, the contacts on the notification appliance mounting plate are always covered and protected by the contact cover. This is not true with other contact covers currently used because the contact cover needs to be removed to properly install the notification appliance mounting plate or the wires on the terminals of the notification appliance mounting plate.

At step 1512, the method 1500 removes the contact cover after performing the connectivity test. At step 1514, the method 1500 couples a notification appliance to the notification appliance mounting plate. The method 1500 ends at step 1516.

It should be noted that steps or blocks in the accompanying Figures that recite a determining operation or involve a decision, do not necessarily require that both branches of the determining operation be practiced. In other words, one of the branches of the determining operation can be deemed as an optional step. Moreover, although steps of the methods described above may be illustrated in a certain sequence, those skilled in the art will appreciate that the steps of the methods described need not necessarily occur in the order illustrated. Thus, the accompanying Figures do not illustrate a mandatory sequential order.

Although various embodiments which incorporate the teachings of the present invention have been shown and described in detail herein, those skilled in the art can readily devise many other varied embodiments that still incorporate these teachings.

What is claimed is:

1. A mounting plate and contact cover, comprising:

a notification appliance pre-wire mounting plate, wherein the notification appliance pre-wire mounting plate comprises:

one or more terminals for receiving a wire;

one or more contacts; and one or more polarized openings; and a contact cover coupled to the notification appliance pre-wire mounting plate where each one of the one or more contacts is covered and each one of the one or more terminals is not covered, wherein the contact cover comprises:

a plastic body;

at least one piece of metal in contact with the one or more contacts;

a means for coupling said at least one piece of metal to said plastic body; and one or more polarized tabs mated with a respective one of the one or more polarized openings.

2. A mounting plate and contact cover, comprising:

a notification appliance pre-wire mounting plate, wherein the notification appliance pre-wire mounting plate comprises:

one or more terminals for receiving a wire;

one or more contacts; and one or more polarized openings; and a contact cover coupled to the notification appliance pre-wire mounting plate where each one of the one or more contacts is covered and each one of the one or more terminals is not covered, wherein the contact cover comprises:

a plastic body;

a metal shunt in contact with the one or more contacts;

a locking tab for locking the metal shunt to the plastic body; and one or more polarized tabs mated with a respective one of the one or more polarized openings.

3. The mounting plate and contact cover of claim 2, wherein the plastic body comprises an interior volume and the metal shunt and the locking tab are in the interior volume of the plastic body.

4. The mounting plate and contact cover of claim 2, wherein the one or more polarized tabs allow for installation in only one direction of the contact cover.

5. The mounting plate and contact cover of claim 4, wherein the polarized tabs comprise:

a first sized tab coupled to the plastic body that mates with a first sized opening of the one or more polarized openings on the notification appliance pre-wire mounting plate; and a second sized tab coupled to the plastic body that mates with a second sized opening of the one or more polarized openings on the notification appliance pre-wire mounting plate.

6. The mounting plate and contact cover of claim 2, wherein a divider is coupled to the metal shunt for creating two separate contact areas.

7. The mounting plate and contact cover of claim 6, wherein the metal shunt comprises at least one dimple in each of the two separate contact areas to prevent the metal shunt from sliding out of the plastic body.

8. The mounting plate and contact cover of claim 2, wherein the locking tab maintains the metal shunt at a proper elevation to make a proper connection with the one or more contacts of the notification appliance pre-wire mounting plate.

9. The mounting plate and contact cover of claim 2, wherein the metal shunt is positioned within the plastic body where when the contact cover is installed onto the notification appliance pre-wire mounting plate, the metal shunt contacts two or more contacts of the notification appliance pre-wire mounting plate.

10. The mounting plate and contact cover of claim 2, wherein the metal shunt comprises a thin rectangular piece of phosphor bronze.

* * * * *